United States Patent [19]

Matsumoto et al.

[11] 4,121,101

[45] Oct. 17, 1978

[54] METHOD OF RECORDING RADIOGRAPHIC IMAGES

[75] Inventors: Seiji Matsumoto, Minami-ashigara; Isoji Takahashi, Asaka; Takao Komaki; Masamitsu Ishida, both of Minami-ashigara; Tomotaka Kozeki, Tokyo; Kazuo Horikawa; Kozi Shimanuki, both of Asaka, all of Japan

[73] Assignee: Fuji Photo Film Co., Ltd., Minamiashigara, Japan

[21] Appl. No.: 744,119

[30] Foreign Application Priority Data

Nov. 21, 1975 [JP] Japan ..... 50-139960
Nov. 21, 1975 [JP] Japan ..... 50-139961

[22] Filed: Nov. 22, 1976

[51] Int. Cl.[2] ..... G03G 13/00
[52] U.S. Cl. ..... 250/315 A; 250/320
[58] Field of Search ..... 250/315 R, 315 A, 320

[56] References Cited

U.S. PATENT DOCUMENTS

| | | | |
|---|---|---|---|
| 3,603,790 | 9/1971 | Cleare | 250/315 A X |
| 3,949,222 | 4/1976 | Lewis | 250/315 A |
| 3,970,844 | 7/1976 | Fenn, Jr. et al. | 250/315 A X |
| 4,030,922 | 6/1976 | Honjo et al. | 250/315 A X |

*Primary Examiner*—Archie R. Borchelt
*Attorney, Agent, or Firm*—Gerald J. Ferguson, Jr.; Joseph J. Baker

[57] ABSTRACT

In Reiss chamber method or ionography, or in a method of modification or combination of these methods wherein an electrostatic latent image of an object irradiated with radiations such as X-rays is formed on an insulating image recording layer, a photoconductive material is used as the image recording layer. The charge carried on the photoconductive image recording layer is partly neutralized by the radiations received thereby. In an embodiment, a fluorescent layer is attached to the photoconductive image recording layer to accelerate the neutralization of the charge when the recording layer is exposed to the radiations. In another embodiment, the photoconductive material has a property that the photoconductivity increases as the strength of an electric field applied thereacross increases, and the image recording layer made of such a photoconductive material is uniformly exposed to light simultaneously with or after the irradiation of the radiations.

9 Claims, 7 Drawing Figures

METHOD OF RECORDING RADIOGRAPHIC IMAGES

BACKGROUND OF THE INVENTION

1. Field of the Invention

This invention relates to method of recording radiographic images on a recording material by use of radiations such as X-rays, and more particularly to improvements in the method of recording radiographic images on a recording material by use of electrostatic latent images formed with charged particles emitted by a material which is irradiated with radiations having high energy such as X-rays, gamma rays and so forth.

2. Description of the Prior Art

It has been known in the art to use radiations for recording images of an object on a recording material. One of those methods employs an ordinary photographic film. Another method employs a xerographic photosensitive material which is exposed to X-rays after uniformly charged with electric charges to form an electrostatic latent image thereon. This method is called "xeroradiography" and is disclosed, for instance, in U.S. Pat. No. 2,666,144. The electrostatic latent image thus formed is developed on the recording material or developed after transferred to an insulating plate by use of toners as well known in the art.

Further, it has been known in the art, as disclosed in Japanese Patent Public Disclosure No. 48-82791/1973, to record images on a recording material by forming and developing an electrostatic latent image on an insulating recording material by ionizing a gas with X-rays and collecting ionized charges on the insulating recording material. This is called "ionography".

In addition, it has also been known in the art to record images on a recording material by forming and developing an electostatic latent image on an insulating recording material by irradiating a cathode of metal having a large atomic number with X-rays to cause the cathode to emit photoelectrons and collecting the photoelectrons on the insulating recording material disposed on an anode of metal having a small atomic number which is arranged in parallel to the cathode by applying an electric field across the cathode and anode. This method is called Reiss chamber method and is disclosed, for instance, in Japanese Patent Public Disclosure No. 49-95595 and a magazine of applied physics. i.e. Zeitschrift für Angewandt Physik vol. 19, pages 1–4 (issued Feb. 19, 1965).

It is possible to apply a method as disclosed in U.S. Patent No. 2,900,515 to the above mentioned methods. In other words, an insulating recording layer of a recording material is first uniformly charged and then the charges carried on the recording layer are neutralized by charges having opposite polarity to that of the charges on the recording layer generated by the method of ionography or Reiss chamber. The image obtained by this method has a pattern reversed with respect to that obtained by the above mentioned methods.

Further, it is possible to combine the first two methods as suggested in Japanese Patent Public Disclosure No. 50-68340/1975. Japanese Patent Public Disclosure No. 50-33839/1975 shows a method wherein ions generated by irradiation of radiations are amplified by use of a micro-channel plate. Japanese Patent Public Disclosure No. 50-87793 shows a method wherein dielectric liquid is used as a substance to conduct photoelectric conversion.

The ionography and Reiss chamber method are advantageous over said xeroradiography in that the sensitivity thereof is several tens of times as high as that of the xeroradiography and these methods do not use expensive photosensitive materials. Further, these methods using a latent image formed on a recording material are advantageous over the conventional radiography using a photosensitive material in that the local contrast of the image obtained thereby is much higher than that of the image obtained by the radiography. Therefore, these methods are advantageous in obtaining diagnosis information in great detail.

However, these methods using an electrostatic latent image to be developed with toners are disadvantageous in that the gradation reproductibility of a high density part of the image is insufficient.

A detailed description of the above mentioned conventional methods will be made hereinbelow with reference to the drawing and the aforesaid disadvantages will be further explained in detail. Thereafter, the present invention will be described in detail. The method in accordance with the present invention uses the same recording device as that employed in the above methods such as the ionography and Reiss chamber method.

DETAILED DESCRIPTION OF THE PRIOR ARTS

Figure 1:
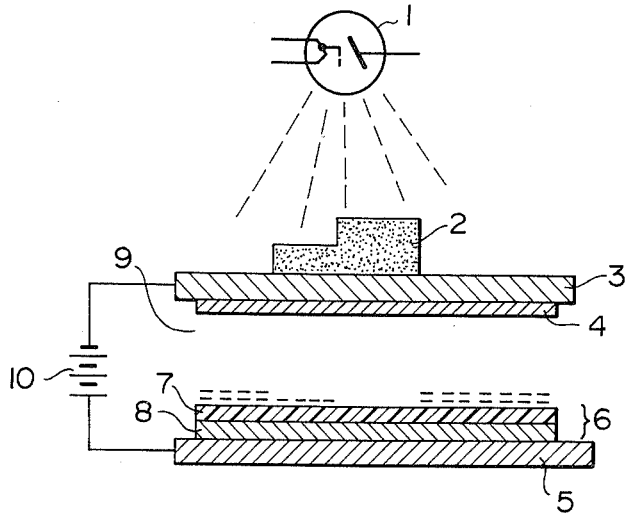
FIG. 1 shows a recording device arrangement used in the Reiss chamber method which is also used in the method of the present invention.

Referring to FIG. 1 showing the recording device arrangement used in the Reiss chamber method, under an X-ray tube 1 is located an object 2 the image of which is to be recorded. The object 2 is placed on a cathode 3 which has on the back face thereof a photoelectron emitting layer 4. The photoelectron emitting layer 4 is made of a metal having a large atomic number such as lead or lead oxide which emits photoelectrons upon absorption of X-rays or the like. In parallel to the cathode 3, an anode 5 made of a metal having a small atomic number such as aluminium is provided. On the anode 5 is placed a recording material 6 so that the recording material 6 is opposed to the photoelectron emitting layer 4 on the cathode 3. The recording material 6 is composed of a comparatively thin conductive substrate 8 and an insulating recording layer 7. The conductive substrate 8 may be a metal plate or a plastic film carrying thereon a coating layer of a conductive material. When the plastic film carrying a conductive coating layer is used as the substrate 8, the conductive layer should be electrically connected with the anode 5 so that the conductive layer may be impressed with an electric potential with respect to the cathode 3. The conductive layer may be substituted for the anode. In this case, the anode can be eliminated. The cathode 3 and the anode 5 or the conductive layer are connected with a DC power source 10 to provide an electric field between the cathode 3 and the anode 5.

Between the photoelectron emitting layer 4 and the recording material 6 is provided a space 9. The distance between the surface of the layer 4 and the surface of the recording material 6 is 0.1 to 10mm. The space 9 therebetween is filled with a gas or mixture of gases which emits secondary electrons such as a quenching gas mainly composed of Ar, Xe or Kr, a mixture of argon and methanol, a mixture of fluorine hydrocarbon and propane or the like. In order to seal such a gas or mixture of gases in the space between the cathode and anode, an air-tight means is provided, which is not shown in the drawing.

In operation of the image recording arrangement as shown in FIG. 1, the X-rays irradiated by the X-ray tube 1 are absorbed by the object 2 on the cathode 3. The object 2 has various parts which have various X-ray absorbancy. Therefore, the photoelectron emitting layer 4 is exposed to imagewise X-ray and the absorption dose thereof differs in a pattern corresponding to the image of the object 2. Accordingly, the photoelectron emitting layer 4 emits various amount of photoelectrons according to the pattern like distribution of the absorption dose thereof. The photoelectrons thus emitted by the layer 4 are accelerated by the electric field made across the space 9 and are caused to collide with the gas in the space 9 to have secondary electrons be generated. Thus, a number of electrons are generated in the space 9 and are collected on the surface of the recording material 6. The electrons collected on the surface of the recording material 6 form a charge image thereon as an electrostatic latent image. The latent image is developed by use of toners as well known in the art.

Figure 2:
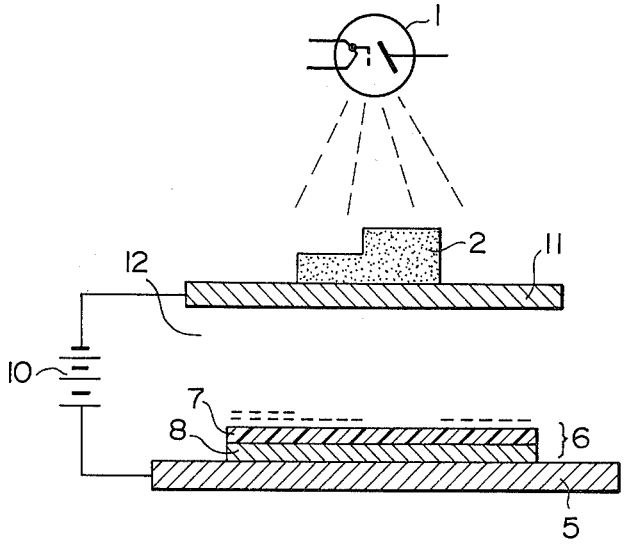
FIG. 2 shows a recording device arrangement used in the ionography which is also used in the method of the present invention.

FIG. 2 shows a recording system used in the ionography in which a photoelectron emitting layer is not employed. In the ionography, the gas between the electrodes is ionized directly by X-rays. Referring to FIG. 2, a cathode 11 and an anode 5 are arranged in the same manner as that employed in the method shown in FIG. 1. However, the cathode 11 in this method is made of a metal having a small atomic number such as aluminium or alloy of aluminium so that X-rays may easily pass therethrough. The space 12 between the cathode 11 and a recording material 6 placed on the anode 5 is filled with a gas having a large atomic number such as Ar, Xe or Kr. The recording material 6 is the same as that employed in the Reiss chamber method as shown in FIG. 1 and is composed of a recording layer 7 and a conductive substrate 8. The gas filling the space 12 should preferably be easily ionized, and accordingly, the pressure thereof is preferred to be high. In operation of the image recording arrangement as shown in FIG. 2, the charged particles ionized by the X-ray are collected on the surface of the image recording layer 7 by the electric field applied between the cathode 11 and the anode 5. Thus, an electrostatic latent image is formed on the image recording layer 7 of the image recording material 6.

The present inventors have found that the amount of electric charges collected on the recording material is in proportion to the exposure dose of X-rays received by the photoelectron emitting layer 4 or the gas filling the space between the electrodes 3 and 5 and accordingly the optical density of the image obtained thereon is in proportion to the exposure dose of the X-rays. The relationship between the optical density and the exposure dose will be described with reference to FIGS. 3 and 4.

Figure 3:
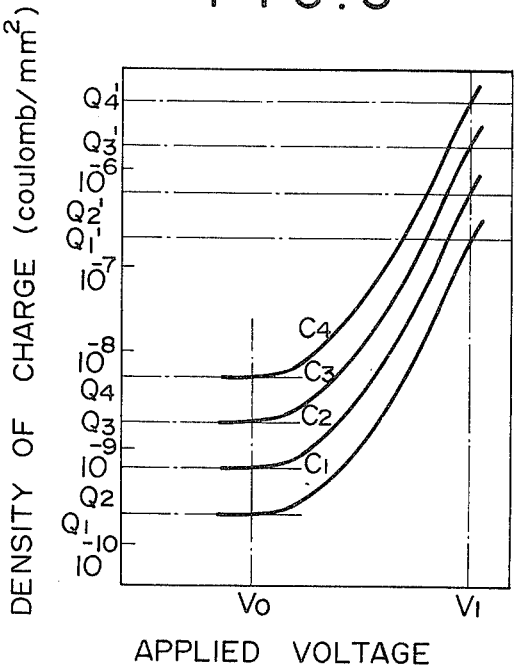
FIG. 3 is a graphical representation showing the relationship between the density of charge collected on the surface of the recording material and the voltage applied across the recording material.

FIG. 3 shows the relationship between the density of charge collected on the recording material and the voltage applied between the cathode and anode in the Reiss chamber method shown in FIG. 1. The ordinate represents the density of charge in log scale and the abscissa represents the voltage applied. Further, in the graph, curves $C_1$, $C_2$, $C_3$, and $C_4$ represent the exposure dose absorbed by the photoelectron emitting layer 4, i.e. 1mR, 4mR, 16mR and 64mR, respectively. $Q_1$ to $Q_4$ show the density of charge obtained by exposure dose of $C_1$ to $C_4$ when the applied voltage is $V_0$, respectively. $Q_1'$ to $Q_4'$ show the density of charge obtained by exposure dose of $C_1$ to $C_4$ respectively when the applied voltage is $V_1$.

As shown from this graph, the density of electric charge increases as the applied voltage increases. Further, the density of the charge increases as the exposure dose increases. More exactly, as shown in the graph, the ratio of the density of charge for one exposure dose to the density of charge for another exposure dose under one voltage is the same as that under another voltage, which means that the density of charge is in proportion to the exposure dose of the X-rays. Through the above graph has been prepared for the Reiss chamber method as shown in FIG. 1, the same results are applicable to the ionography as shown in FIG. 2.

Figure 4:
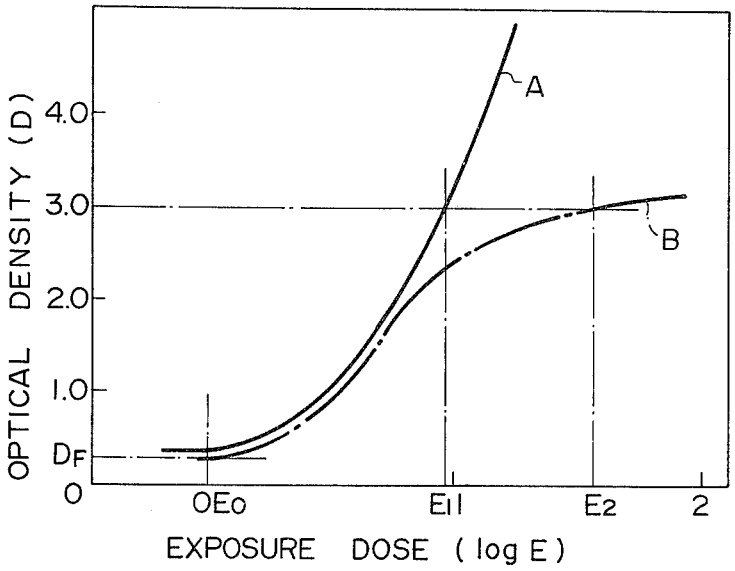
FIG. 4 is a graphical representation showing the relationship between the optical density of the image formed on the recording material and the exposure dose of the X-ray effecting on a photoelectron emitting layer provided above the recording material in the Reiss chamber method or on the gas existing above the recording material in the ionography.

FIG. 4 shows the relationship between the optical density of the image obtained on the recording material and the exposure dose effecting on the photoelectron emitting layer 4 or the gas filling the space between the the cathode 3 and the recording material 6. The abscissa represents the exposure dose in log scale and the ordinate represents the optical density of the image obtained on the recording material. In FIG. 4, curve-A shows the characteristic of the image formed in accordance with the method of recording images by use of radiations based on electrophotography such as the Reiss chamber method or ionography (hereinafter referred to simply as "radiation electrophotography"), and curve-B shows the characteristic of the image obtained by the conventional normal radiography using a silver halide photosensitive material. In the radiation electrophotography as shown by the curve-A, the optical density is in proportion to the exposure dose and accordingly the optical density of the image increases as the exposure dose increases. On the other hand, in the normal radiography, the optical density is not in proportion to the exposure dose and is saturated when the exposure dose reaches a predetermined value as shown by the curve-B.

Under the normal condition of observation, the range of density wherein the difference in density is recognizable is limited and no image can be observed if the density thereof is too high. Therefore, an image or a portion of an image which has too high optical density is practically of no use. As shown in FIG. 4, when the upper limit of the optical density which can be recognized with human eyes is assumed to be 3.0, the range of the exposure dose which is useful for observation is represented by upper limit of $E_1$ and lower limit of $E_0$ wherein $E_0$ corresponds to the density of fog $D_F$ in curve-A whereas the range is represented by upper limit of $E_2$ and lower limit of $E_0$ in curve-B. According to out experiments, the range of $E_0$–$E_1$ that is $\Delta\log E_A$ was proved to be 1.7–1.9 and the range of $E_0$–$E_2$ that is $\Delta\log E_B$ was proved to be 2.5–3.0. Thus, the range of the exposure dose which is useful for observation or analysis of image information is narrow in the radiation electrophotography in comparison with the normal radiography.

Figure 5:
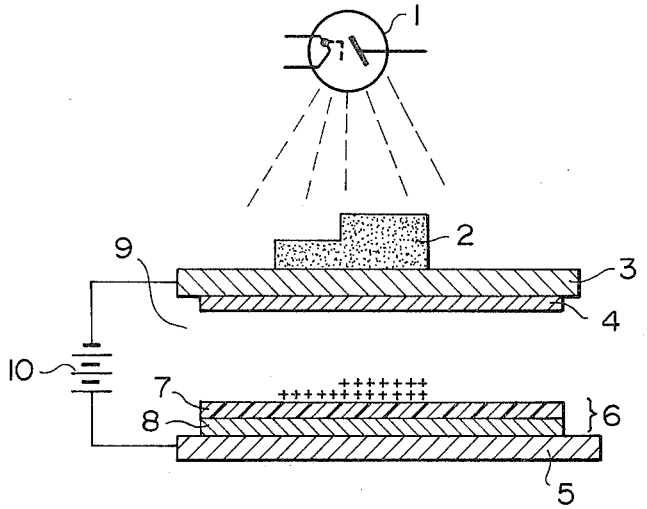
FIG. 5 shows a recording device arrangement used in a method in which the Reiss chamber method is modified.
Figure 6:
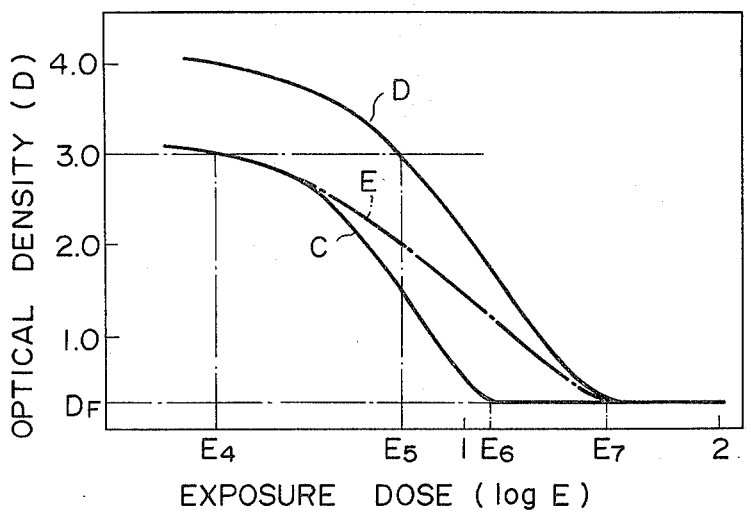
FIG. 6 is a graphical representation showing the relationship between the optical density of the image formed on the recording material and the exposure dose of the X-ray effecting on a photoelectron emitting layer provided above the recording material in the method illustrated in FIG. 5.

A modification of the Reiss chamber method will hereinbelow be described with reference to FIGS. 5 and 6. In this method, a recording material is uniformly charged in advance and the charge thereon is neutralized by electrons generated by exposure of X-rays transmitting through an object. Thus, the uniform distribution of the charge on the recording material is imagewise neutralized to form an electrostatic latent image. Referring to FIG. 5, all the same elements as those employed in the Reiss chamber method shown in FIG. 1 are used and are designated with the same reference numerals. In the illustrated embodiment, the recording material 6 is first charged in positive polarity. Then, X-rays are emitted by the X-ray tube 1 and the photoelectron emitting layer 4 is exposed to the X-rays through the object 2. The layer 4 emits photoelectrons to a degree corresponding to the absorption dose absorbed thereby. The photoelectrons are accelerated by the electric field applied across the space 9 and the number of electrons is amplified by collision of the photoelectrons with the gas in the space 9. The electrons collected on the surface of the recording layer 7 of the recording material 6 neutralize the charges thereon. Thus, the uniformly provided charges are imagewise neutralized to form an electrostatic latent image. Since the charges are neutralized where the X-rays are not absorbed by the object, the latent image obtained by this method is reversed with respect to the latent image obtained by the aforesaid two methods as shown in FIGS. 1 and 2.

In the modified Reiss chamber method also, the amount of electric charges reaching the surface of the recording material is in proportion to the exposure dose of the X-rays. In more detail, as shown in FIG. 6, curve-C which represents the characteristic of the image formed on the recording material 6 where the maximum optical density is selected to be about 3.0 shows that the exposure dose of X-rays is useful for observation only between $E_4$ ad $E_6$. When the maximum optical density is selected to be over 3.0 as shown by curve-D, the upper limit of the range of the exposure dose where the obtained image is useful for observation is raised from $E_6$ to $E_7$, but the lower limit is also changed from $E_4$ to $E_5$ which results in narrowing of the range.

As seen from the foregoing observations of the conventional radiation electrophotography, the range of the exposure dose which results image formation useful for observation is narrow in comparison with the conventional radiography employing silver halide photosensitive materials. Further, in comparison therewith the gradation reproductibility of the radiation electrophotography.

SUMMARY OF THE INVENTION

In view of the above mentioned defects inherent in the conventional radiation electrophotography, the primary object of the present invention is to provide a method of recording images by use of radiations such as X-rays which has a large range of exposure dose that results formation of an image having a proper gradation which can be observed as an image. In other words, the object of the present invention is to provide a method of recording images by use of radiations which has a large latitude in exposure dose.

Another object of the present invention is to provide a method of recording images by use of radiations such as X-rays which has a high gradation reproductibility in the region of high optical density.

In accordance with the present invention, the above objects are accomplished by using a photoconductive layer as the image recording layer in the aforesaid various conventional radiation electrophotographic methods. The photoconductive layer receives the radiation simultaneously with the formation of the charge image, so that the charges in the high density area are neutralized by the radiation. Thus, the density of the electrostatic latent image in the regions of too high density is lowered by the radiation and the characteristic curve becomes like said curve-B in FIG. 4.

The above objects of the present invention are further accomplished by employing a fluorescent layer attached to the back surface of the recording material. The fluorescent layer is attached on the back surface of the conductive substrate of the recording material and the conductive substrate is made transparent. Upon receipt of radiation, the fluorescent layer emits light to accelerate the neutralization of charges on the recording layer of the recording material.

The objects of the present invention is further accomplished by employing a special photoconductive layer as the image recording layer. The special photoconductive layer is made of a photoconductive material which increases its photoconductivity as the strength of electric field applied thereto increases. The recording material employing the special photoconductive layer is exposed to light simultaneously with or after the formation of the electrostatic latent image. By exposing the special photoconductive layer to uniform light simultaneously with or after the formation of the electrostatic latent image, the areas in which the density of the latent image is high is subjected to higher effect of neutralization since the photoconductivity of the layer in said areas is increased by the high density latent image.

Thus, in accordance with the present invention, the range of exposure dose that results formation of an image of proper gradation is enlarged, and the gradation reproductibility in the region of high optical density is enhanced.

DETAILED DESCRIPTION OF THE INVENTION

Referring to FIG. 1, an embodiment of the present invention is applied to the Reiss chamber method. In accordance with the present invention, the insulating recording layer 7 of the image recording material 6 is replaced by a photoconductive layer. The photoconductive layer substituted for the insulating recording layer 7 is sensitive to visual light or light having a wavelength close to that of visual light and/or X-rays. All other elements constituting the image recording arrangement as shown in FIG. 1 are used as they are.

In operation, the object 2 is exposed to X-rays from the X-ray tube 1. The photoelectron emitting layer 4 emits photoelectrons of the amount proportional to the dose absorbed thereby. Further, the X-rays transmit through the layer 4. The dose of the X-ray transmitting through the layer 4 is high in the area where the dose absorbed thereby is high. In other words, the distribution of the dose absorbed by and transmitting through the photoelectron emitting layer 4 corresponds to the pattern of the object 2 placed on the cathode 3. Thus, the recording layer 7 receives a large amount of electrons and a high dose of X-rays in the area where the X-rays do not pass through the object 2.

Now comparing the amount of electrons or electric charges received with the dose of X-rays absorbed by the recording layer 7, the former is much higher than the latter since the former is based on the high sensitivity effected in the Reiss chamber method whereas the latter is based on the low sensitivity effected in the xeroradiography. Therefore, the effect of the neutralization of charges only appears in the area where the density of charge on the recording layer 7 is comparatively high. Further, the neutralization effects only partially on the charges in said area.

As seen from the above, the effect of neutralization of charge is high in the area where the absorption of X-rays by the object is small. Therefore, the effect of neutralization is high in the area of high density of charge. Accordingly, the curve-A shown in FIG. 4 is changed to the curve similar to curve-B. This means that the gradation reproductibility is improved in the region of high exposure dose, i.e. in the area of high optical density of image. Thus, it becomes possible in accordance with the present invention to obtain more information from the radiograph or image recorded by use of X-rays than the conventional radiographic image recording methods.

Referring to FIG. 2, another embodiment of the present invention is applied to the ionography. In accordance with the present invention, the insulating recording layer 7 of the image recording material 6 is replaced by a photoconductive layer. All other elements constituting the image recording arrangement as shown in FIG. 1 are used as they are.

In operation of this arrangement also, the charge on the recording layer 7 is neutralized by exposure thereof to X-rays. The degree of the neutralization is high in the area where the density of charge is high. Since the principle of the neutralization is quite the same as that applied in the first embodiment, the detailed description thereof is omitted here. The X-rays contributing to the neutralization are those that have transmitted through the space 12 without used for ionizing the gas having a large atomic number.

Figure 7:
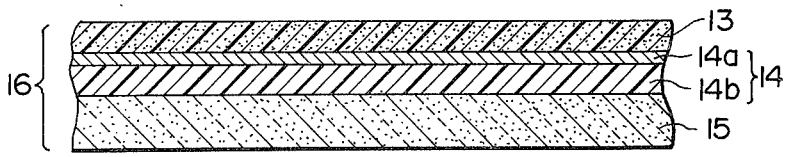
FIG. 7 is a cross sectional view of an example of an image recording material in accordance with a preferred embodiment of the invention in which a fluorescent layer is attached to an image recording layer.

Another embodiment of the present invention is shown in FIG. 7 in which only an image recording material 16 is illustrated. In this embodiment, a fluorescent layer 15 is attached to the back surface of a substrate 14 which carries thereon an image recording layer 13 made of photoconductive material. The substrate 14 consists of a plastic base layer 14*b* and a conductive coating layer 14*a*. The substrate 14 needs to be transparent to light emitted by the fluorescent layer 15. The fluorescent layer 15 contains a phosphor which emits visual light or near ultra-violet rays to which the photoconductive layer 13 is sensitive upon receipt of radiation. For instance, the fluorescent layer comprises powder of [ZnCd]S:Ag dispersed in a transparent insulating material. In accordance with this embodiment, the neutralization of charge on the recording layer 13 is conducted by both the X-rays irradiated from above and the light given from the back emitted by the fluorescent layer 15. Accordingly, the neutralization of the charge on the recording layer 13 in the area of high density is enhanced. Further in accordance with this embodiment, it is possible to easily select the sensitivity of the fluorescent layer 15 to X-rays by changing the kind, diameter of particles of the phosphor and the thickness of the fluorescent layer. It is also possible to control the intensity of the light received by the photoconductive image recording layer 13 by changing the transmittivity of the transparent conductive substrate 14 to the light emitted by the fluorescent layer 15.

Another preferred embodiment of the present invention will be described in detail with reference to FIGS. 5 and 6. FIG. 5 illustrates an arrangement in a modified Reiss chamber method. In this embodiment a recording layer 7 of an image recording material 6 is made of a special photoconductive material having a thickness of 0.2 to 300$\mu$ which increases its sensitivity to light as the electric field applied thereto increases. Preferably, the sensitivity should be predominantly increased when the electric field applied thereto exceeds $10^3$Volt/cm. This is because the electric field provided by the charges carried on the surface of the photoconductive recording layer 7 in the density of charge of $10^{-9}$ coulomb/cm$^2$ and $10^{-6}$ coulomb/cm$^2$ which results development thereof by powder cloud developing process and liquid developing process, respectively, in the optical density of 2.0 to 3.0 is about $10^3$Volt/cm. Thus, when the charges are collected on the surface of the recording layer in the density of higher than the normal density which effects to produce an electric field of $10^3$Volt/cm, the photosensitivity of the photoconductive recording layer 7 is increased. The degree of of the increase in the photosensitivity of the photoconductive layer is preferred to be such that the photosensitivity is raised by 1.3 to 1.5 times as the electric field is raised by twice within the range of the field from $10^3$ to $10^7$ Volt/cm.

In accordance with the present embodiment of the invention, the image recording material 6 is uniformly exposed to light after the electrostatic latent image is formed thereon. By the exposure of the recording material 6 to the light, the photoconductive layer 7 is made conductive to neutralize the charge image thereon. Further, since the photoconductivity of the photoconductive recording layer 7 is increased by the electric field applied thereto, the photoconductivity of the layer 7 in the area where the density of charge is high is comparatively increased. Thus, the gradation reproductibility of the image formed on the image recording material 6 is enhanced to obtain an image of high quality.

As the special photoconductive material used for the image recording layer 7 employed in this embodiment, can be used amorphous selenium, glass-like inorganic material such as $As_2Se$, organic material such as poly-N-vinylcarbazole and trinitrofluorenon, inorganic powder such as lead oxide and titanium oxide mingled with silicone resin or alkyl resin, and organic pigments such as copper phthalocyanine mingled with said resins. These materials increase their photoconductivity markedly upon submission to an electric field.

It will be understood by those skilled in the art that the present invention is applicable to the Reiss chamber method as shown in FIG. 1, the ionography, as shown in FIG. 2, and a method in which these methods are combined as shown in Japanese Patent Public Disclosure No. 50-68340/1975 or to a method in which a dielectric liquid having no polarity is used as a material for conducting photoelectric conversion as shown in Japanese Patent Public Disclosure No. 50-87793/1975. Further, this invention is also applicable to a method as shown in Japanese Patent Public Disclosure No. 50-33839 in which ions generated by use of ionizing radiations are amplified with a microchannel plate, when the X-ray absorption by the microchannel plate is small. It is also possible to apply this invention to a method as shown in Japanese Patent Public Disclosure No. 50-92734 in which a liquid containing ionizing substances and colored fine particles charged in a polarity dispersed therein is used instead of said dielectric liquid shown in said Japanese Patent Public Disclosure No. 50-87793 to form a toner image at the same time as the formation of a latent image.

The electrostatic latent image thus obtained is developed by a proper developing process. There are known various methods of development to visualize the latent image. For instance, a cascade development as shown in U.S. Pat. No. 2,618,551, a magnetic brush development as shown in U.S. Pat. No. 2,786,439, a powder cloud development as shown in U.S. Pat. Nos. 2,691,345 and 2,725,3, an open chamber development, a magnetic dry development as shown in West German Offenlegungschrift No. 2,313,297, an ink mist development, and a liquid development as shown in U.S. Pat. Nos. 2,877,133 and 2,907,674. It is of course possible to transfer the latent image to another layer or to transfer the developed toner image to another image recording material.

Further, although the above described embodiments have been concerned with image formation in which toners are affixed to an area where the charges exist, i.e. a positive image formation. However, it is possible to apply this invention to a negative image formation in which toners are affixed to an area where no charge exist. In such a case, the amount of toners which are affixed to low charge density areas to form high optical density areas is decreased by neutralizing a part of the charge in high charge density areas. Therefore, in this case also, the gradation reproductibility of the image obtained can be enhanced.

As the photoconductive image recording layer 7 of the image recording material 6 can be used all kinds of photoconductive insulating material which is made conductive by exposure to light within the range of visual light or near visual light. Typical inorganic photoconductive insulating materials are zinc oxide, zinc sulfide, cadmium sulfide, titanium oxide mingled with a resin, amorphous selenium, and alloys of selenium and arsenic or tellurium. U.S. Pat. No. 3,121,006 shows various inorganic photoconductive materials. Typical organic photoconductive insulating materials are polyacenaphthylene, polyvinylanthracene and other aromatic vinyl polymers, nitrogen containing heteroacid vinyl polymer, and poly-N-vinylcarbazole. Further, general polymers added with organic photoconductive substances can also be used.

As the conductive substrate 8 can be used ordinary conductive materials such as aluminium, copper, silver, gold and other metals, a glass plate or resin film carrying thereon a thin metal film of aluminium, palladium, copper, silver, gold or the like or a thin film of tin oxide, or paper provided with conductive treating. Agents used for the conductive treating of paper are the same as those employed in the field of electrophotography. For instance, polyvinylbenzyltrimethylammonium chloride, poly(NN-dimethyl-3,5-methylenepiperydium chloride), sodium polyvinyl benzene sulfonate, and colloidal alumina are particularly useful for making the surface of paper conductive. In the embodiment where a fluorescent layer is employed, the conductive substrate should be transparent. Therefore, for instance, a glass plate or a resin film carrying thereon a vacuum deposition of metal is used. Further, in order to control the amount of light passing through the transparent substrate the material used as the substrate may be colored.

As the radiation can be used X-rays, extreme ultraviolet rays, $\gamma$-rays, $\alpha$-rays and other radiations which cause a material to emit secondary electrons or ionize a fluid in a gas or liquid.

Now several examples of the present invention will be shown hereinbelow.

EXAMPLE I

A polyethylene terephthalate film was disposed as an image recording layer on an aluminium substrate in a thickness of 100$\mu$. Besides this recording material, an amorphous selenium was vacuum evaporated on the same substrate in a thickness of 150$\mu$ to prepare a second sample of recording materials. On the recording layer of these recording materials were formed electrostatic latent images in accordance with the method using a recording arrangement as shown in FIG. 1.

As the material for the cathode and anode was used an aluminium plate having a thickness of 2mm. As the photoelectron emitting layer attached to the cathode was used a lead plate having a thickness of 0.3mm attached to the aluminium plate of the cathode. The space between the photoelectron emitting layer and the image recording layer was filled with a mixture of argon and methane mixed in the ratio of 8:2 having a pressure of 1 atm. The distance between the surface of the photoelectron emitting layer and the surface of the image recording layer was 1mm. As an object the image of which is to be recorded was used an aluminium step wedge consisting of 24 steps the thickness of which differs by 3mm. Under the above conditions, X-rays were irradiated upon the object for 20 seconds. The voltage applied to the X-ray tube was 45KVp and the current flowing therethrough was 300mA. The voltage applied between the cathode and anode was 5KV.

Thus, an electrostatic latent image was formed on the image recording layer. The latent image was developed with toners having a positive polarity in accordance with the method of powder cloud development.

As a result, the image formed on the sample carrying a layer of polyethyleneterephthalate showed low gradation reproductibility in the area of high density. In that image the optical density in the area corresponding to the thinnest step of the aluminium step wedge, i.e. the maximum optical density ($D_{max}$), was 5.0 and most of the areas of high density were observed as solid black, whereas the areas of low density showed satisfactory reproductibility. On the other hand, the image formed on the sample carrying a layer of selenium showed high gradation reproductibility in the area of high density. The maximum density was 3.5 and highly reproduced gradation was seen in the high density steps. The gradation in the low density steps was as good as that shown by the former sample.

EXAMPLE II

Two samples of an image recording material as employed in Example I were prepared. These samples were used to form electrostatic latent images thereon in accordance with the same method as that employed in Example I. In this example, however, various conditions were changed from those employed in Example I. The thickness of the photoelectron emitting layer was 0.1mm, the mixing ratio of argon and methane was 9:1, the voltage applied between the cathode and anode was 1.3KV, the X-ray tube voltage was 100KVp, the X-ray tube current was 100mA and the duration of exposure to X-rays was 0.05 second.

Thereafter, in this example the sample carrying the selenium layer was exposed to light from a tungsten lamp with the intensity of illumination of 0.5 lux for 4 seconds.

Thus obtained electrostatic latent images formed on the image recording layer of the two samples were developed by power could development.

As a result, Dmax of the image obtained on the sample carrying the polyethylene terephthalate film was 6.0 and showed low gradation reproductibility in high density areas. On the other hand, Dmax of the image formed on the sample with the selenium layer was 3.2 and excellent gradation reproductibility was shown in the areas of high density.

EXAMPLE III

A solution of 45% by weight of a resin component consisting of 70% by weight of polyvinyl chloride and 30% by weight of polyvinyl aetate in toluene (Trade name of solution: Denka Lac #61) was diluted in buthyl acetate to prepare a resin solution.

The resin solution thus prepared was applied in a dry thickness of 2μ on a conductive substrate (Toray Highbeam T-type 100L-TL02) prepared by vacuum evaporating palladium on a film of polyethylene terephthalate having a thickness of 100μ to prepare a first sample of recording material.

On said conductive substrate was attached a fluorescent screen containing a phosphor of $Cd_2O_2S$:Tb having a thickness of 50μ. On the fluorescent screen was vacuum evaporated gold in a thickness of 50Å. Further on the evaporated deposition of gold was applied in a dry thickness of 2μ poly-N-vinylcarbozole which contains tetracyanoquinodimethane as a sensitizer. Thus, a second sample of recording material was prepared.

An electrostatic latent image was formed on each sample by use of an image recording arrangement as shown in FIG. 2. In the recording arrangement, aluminium plates having a thickness of 4mm were used as the electrodes, which were oppositely disposed with a spacing of 5mm formed therebetween. A voltage of 9KV was impressed between the electrodes. The space between the electrodes was filled with a mixture of xenon and methane mixed in a ratio of 9:1 with a pressure of 3 atm. X-rays were irradiated on an object placed on the cathode for 1.0 second with an X-ray tube voltage of 60KVp and current of 100mA. The object was the same as that employed in Example I.

Then, the recording material carrying thereon a latent image was subject to liquid development and rinsed softly in kerosene. As the liquid developer was used the following material dispersed in a ball mill and diluted in Isopar-H.

Pigment: carbon black, 5% by weight

Binder: alkyd resin (trade name:Super beckosol J537), 20% by weight

Diluting luquid : Isopar-H, small amount

As a result, Dmax of the image formed on the sample with the vinyl resin layer was 6.0 and the gradation reproductibility in the high density areas was impractically low. On the other hand, Dmax of the image on the sample with the poly-N-vinylcarbazole and the fluorescent layer was 2.8. Thus, an image having a good gradation reproductibility over various levels of density could obtained in accordance with the present invention.

EXAMPLE IV

Two samples of image recording material as employed in Example III were prepared. The two samples were quite the same as those employed in Example I except that the thickness of the layer of the solution applied on the conductive substrate was 7μ in both samples.

An electrostatic latent image was formed on each sample by the arrangement as shown in FIG. 1 under the conditions as employed in Example II. In addition, the sample with the layer of poly-N-vinylcarbazole was exposed to light of a tungsten lamp with the intensity of illumination of 100 lux for 1 second.

Then, these samples were subjected to the same process as employed in Example III to develop a toner image thereon.

As a result, Dmax of the image formed on the sample with the vinyl resin layer was 6.0. On the other hand, Dmax of the image formed on the sample with the layer of poly-N-vinylcarbozole was 3.2. Thus, the gradation reproductibility of the image formed in accordance with the present invention was proved to be excellent over the various levels of density.

EXAMPLE V

A sample which is the same as said sample with a layer of poly-N-vinylcarbazole employed in Example IV was used and an electrostatic latent image was formed thereon by the same method as that employed in Example IV except that a nesaglass was used as the anode and the uniform exposure to light of the recording material was performed simultaneously with the exposure thereof to X-rays. The conditions of exposure was the same as those employed in Example IV. The results obtained were the same as those obtained in Example IV.

EXAMPLE VI

The thickness of the recording layers of the samples employed in Example IV was changed to 30μ. Each sample was subjected to uniform charging of +800V before the exposure to X-rays. After the formation of latent images, only the sample carrying the layer of poly-N-vinylcarbazole was exposed to light for 1 second.

Thereafter, the latent image thus formed was developed by powder cloud development using toners having a negative polarity. Consequently, a positive-to-positive image was obtained wherein the areas corresponding to the thick steps of the aluminium step wedge were developed in high density.

In this example also, the image obtained on the recording material carrying a layer of poly-N-vinylcarbazole showed high reproductibility of gradation over the various levels of density.

EXAMPLE VII

The same samples as those employed in Example IV were used and electrostatic latent images were formed thereon by the same method as conducted in Example III using the arrangement shown in FIG. 2.

Aluminium plates having a thickness of 5mm were used as electrodes. The spacing between one electrode and the recording material on the other electrode was made 10mm. The space between the electrodes was filled with xenon gas having a pressure of 5 atm. A voltage of 12KV was applied between the electrodes.

While the electrodes are impressed with the voltage, the recording material was exposed to X-rays for 0.1 second emitted by the X-ray tube excited by a potential of 70KVp and a current of 100mA. The sample with the poly-N-vinylcarbazole layer was exposed uniformly to light in the same manner as employed in Example IV.

The results obtained were the same as those obtained in Example IV.

We claim:

1. A method of recording a radiographic image on a recording material wherein radiations are irradiated through an object the image of which is to be recorded, the radiations being capable of causing a material to emit secondary electrons or ionize a fluid in a gas or liquid where the radiations passing through the object are further irradiated upon a substance which emits charged particles upon receipt of the radiations, the amount of the charged particles emitted thereby being large where the dose of radiations received thereby is large, an insulating latent image recording layer is located being faced to said substance, and an electric field is applied across a space where said charged particles are emitted and said insulating latent image recording layer for collecting said charged particles on the surface of the recording layer to form an electrostatic latent image in a pattern representing a radiographic image of said object, wherein the improvement comprising making said insulating latent image recording layer of a photoconductive insulating material responsive to said radiations and attaching said layer on a conductive substrate, and partly neutralizing the charge of the electrostatic latent image formed on the photoconductive insulating latent image recording layer with the radiations passing through said object and said substance and irradiated upon the surface of the recording layer, the responsiveness of said photoconductive insulating layer to said radiations contributing to the partial neutralization of said charge of the electrostatic latent image.

2. A method of recording a radiographic image as defined in claim 1 further comprising attaching a layer of fluorescent material on the back surface of said conductive substrate, said fluorescent material emitting light having a wavelength of visual light or near visual light upon excitation thereof by said radiations, whereby the light emitted by the fluorescent material further contributes to the partial neutralization of the charge of said electrostatic latent image.

3. A method of recording a radiographic image as defined in claim 1 wherein said photoconductive insulating latent image recording layer is made of a photoconductive insulating material having a property that the photoconductivity thereof increases as the strength of an electric field applied thereacross increases, said method further comprising uniformly exposing said recording layer to light simultaneously with the application of said electric field across the layer.

4. A method of recording a radiographic image as defined in claim 1 wherein said photoconductive insulating latent image recording layer is made of a photoconductive insulating material having a property that the photoconductivity thereof increases as the strength of an electric field applied thereacross increases, said method further comprising uniformly exposing said recording layer to light after the application of said electric field across the layer.

5. A method of recording a radiographic image on a recording material wherein radiations are irradiated through an object the image of which is to be recorded, the radiations being capable of causing a material to emit secondary electrons or ionize a fluid in a gas or liquid where the radiations passing through the object are further irradiated upon a substance which emits charged particles upon receipt of the radiations, the amount of the charged particles emitted thereby being large where the dose of radiations received thereby is large, an insulating latent image recording layer is located being faced to said substance, said insulating latent image recording layer is uniformly charged in positive polarity prior to the irradiation of said radiations, and an electric field is applied across a space where said charged particles are emitted and said insulating latent image recording layer for collecting said charged particles on the surface of the recording layer to neutralize the charge thereon and form an electrostatic latent image in a pattern representing a radiographic image of said object, wherein the improvement comprising making said insulating latent image recording layer of a photoconductive insulating material having a property that the photoconductivity thereof increases as an electric field applied thereacross increases and attaching said layer on a conductive substrate, and uniformly exposing said recording layer to light simultaneously with the application of said electric field across the layer.

6. A method of recording a radiographic image on a recording material wherein radiations are irradiated through an object the image of which is to be recorded, the radiations being capable of causing a material to emit secondary electrons or ionize a fluid in a gas or liquid where the radiations passing through the object are further irradiated upon a substance which emits charged particles upon receipt of the radiations, the amount of the charged particles emitted thereby being large where the dose of radiations received thereby is large, an insulating latent image recording layer is located being faced to said substance, said insulating latent image recording layer is uniformly charged in positive polarity prior to the irradiation of said radiations, and an electric field is applied across a space where said charged particles are emitted and said insulating latent image recording layer for collecting said charged particles on the surface of the recording layer to neutralize the charge thereon and form an electrostatic latent image in a pattern representing a radiographic image of said object, wherein the improvement comprising making said insulating latent image recording layer of a photoconductive insulating material having a property that the photoconductivity thereof increases as an electric field applied thereacross increases and attaching said layer on a conductive substrate, and uniformly exposing said recording layer to light after the application of said electric field across the layer.

7. A method as in claim 1 where said radiations are selected from the groups consisting of X-rays, extreme ultraviolet rays, $\gamma$-rays and $\alpha$-rays.

8. A method as in claim 5 where said radiations are selected from the groups consisting of X-rays, extreme ultraviolet rays, $\gamma$-rays and $\alpha$-rays.

9. A method as in claim 6 where said radiations are selected from the groups consisting of X-rays, extreme ultraviolet rays, $\gamma$-rays, and $\alpha$-rays.

* * * * *